US007543905B2

(12) United States Patent
Rius et al.

(10) Patent No.: US 7,543,905 B2
(45) Date of Patent: Jun. 9, 2009

(54) METHOD FOR AUTOMATIC PEN ALIGNMENT IN A PRINTING APPARATUS

(75) Inventors: Marti Rius, Barcelona (ES); Jose M Rio Doval, Barcelona (ES); Marcos Casaldaliga, Barcelona (ES); Carles Flotats, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 332 days.

(21) Appl. No.: 11/699,558

(22) Filed: Jan. 30, 2007

(65) Prior Publication Data

US 2008/0180479 A1 Jul. 31, 2008

(51) Int. Cl.
*B41J 29/393* (2006.01)

(52) U.S. Cl. ..... 347/19

(58) Field of Classification Search ..... 347/19, 347/16, 104, 105; 271/10.02, 10.03, 226–227, 271/259

See application file for complete search history.

(56) References Cited

U.S. PATENT DOCUMENTS 6,281,908 B1 8/2001 Gibson et al.
6,834,928 B2 12/2004 Rio Doval et al.
6,929,342 B2 8/2005 Claramunt et al.
6,929,344 B2 * 8/2005 Hwang ..... 347/19
6,983,218 B2 1/2006 Ruiz et al.
7,420,719 B2 * 9/2008 Mongeon ..... 358/504
2003/0095722 A1 5/2003 Regimbal

* cited by examiner

*Primary Examiner*—Lamson D Nguyen

(57) ABSTRACT

A method for automatic pen alignment in a printing apparatus, wherein the printing apparatus has a scan direction or x-axis and a media advance direction or y-axis, orthogonal to said scan direction or x-axis, the method comprising the steps of performing a pen alignment process, determining an alignment correction algorithm to be applied during subsequent printing, to compensate for the misalignment determined in said pen alignment process, measuring an output angle of the media, defined as the angle between the y-axis and the actual direction of advance of the media, with at least one optical sensor arranged stationary on the printing apparatus, and employing the measured output angle to modify the alignment correction algorithm to be applied during subsequent printing.

20 Claims, 5 Drawing Sheets

METHOD FOR AUTOMATIC PEN ALIGNMENT IN A PRINTING APPARATUS

The present invention relates to a method for automatic pen alignment in a printing apparatus.

In a printing apparatus such as an inkjet printer, a print media travels under one or several pens or printheads which deposit ink on the media.

The print media is a sheet or web of paper or other material; the printheads may be arranged on a carriage that reciprocates along a scan direction, also referred to as x-axis or horizontal axis, orthogonal to the intended media advance direction, which is also referred to as y-axis or vertical axis.

Each printhead comprises an array of nozzles from which ink is fired in order to form ink dots on the media.

Printing may be performed in successive swaths, between which the media is advanced a distance equal to the swath height; the desired image may be formed in a single pass or by multi-pass printing.

Accurate positioning of the dots of ink fired by the printheads is an issue in any printing mode, since it affects the printing quality and it needs to be controlled to avoid visible defects in the printed plots.

There are several different aspects which may be responsible for errors in the positioning of the ink dots on the media, such as for example misalignment of the printheads due to tolerances in the manufacture of the printhead and/or in their positioning on the carriage, or for example media skew, i.e. lateral displacement or rotation of the media within the media transport mechanism due to slippage and/or to an inaccurate initial positioning of the media.

In order to reduce positioning errors and therefore improve printing quality, several calibration methods have been proposed.

One of such calibration methods is automatic pen alignment, which is aimed at measuring the relative position between the printheads and the media advance direction, compare it with a theoretical relative position, and apply during printing a correction to compensate the error, i.e. to take into account during printing where each dot of ink will really fall when fired from the printhead.

This process helps reducing a printing defect often referred to as lack of vertical line straightness: this defect consists in that a vertical line (i.e. a line in the media advance direction) that should appear straight and continuous is printed as a plurality of short stepped lines.

The process generally involves printing a vertical line of marks, i.e. a line of marks in the direction of advance of the media, and then advance the media stepwise, detecting at each step the position of the successive printed marks by means of a line sensor which is arranged on the printhead carriage.

If the result of the check is that the marks are indeed vertically aligned with each other, then the printhead is already aligned with the media advance direction, and no correction is needed.

However, if it is found that the printed marks are arranged on a line at an angle to the vertical or media advance direction, this indicates misalignment between the printhead and the media advance direction; therefore, as a result of the calibration process, an appropriate correction algorithm is applied to the printing operation.

With this method, the correction is determined and implemented independently from the actual cause or source of misalignment, e.g. the printhead being tilted with respect to the carriage, the media advancing in a direction not exactly vertical, etc. Indeed, the correction should ideally solve the dot positioning errors with no need to identify or quantify each of their causes individually.

However, if the alignment process is performed when one or more of the parameters of the system is in an unstable or transitional condition, and the correction is applied later in a stable condition in which the parameter has a different value from the value it had during the alignment process, then the result will not be satisfactory, and the printing quality will not be improved as much as desirable.

Automatic pen alignment is typically run every time a new printhead is placed in the printer, but it can also be run at other times, for example in a troubleshooting check; and, generally, the user can trigger it at any desired time. For example, in the case of printers that use a roll of print media, it is common for a user to run automatic pen alignment when a new roll of media is loaded in the printer.

It has been found that when a new roll of print media is loaded and advances through the printer, uncontrolled media stabilization movements occur for some time before a stable direction of advance is adopted by the media. As explained above, if an automatic pen alignment process is performed during this stage, for example triggered by the user, the correction provided by the process will not be appropriate to obtain good printing quality.

The solutions provided so far for reducing the effect of media stabilization movements on automatic pen alignment have not been satisfactory. Some examples of these solutions are advancing media until its movement is stabilized, which involves a large amount of wasted media; performing forward and backward movements to accelerate stabilization, which is time consuming and requires to have a rewind motor in the spindle; or requiring very accurate positioning of the media in the loading operation, which increases the number of times that the media loading operation is rejected and the user has to repeat the process. Furthermore, these solutions are only applicable at the time the media is loaded in the printer, but not during printing on the web of media.

U.S. Pat. No. 6,983,218 discloses an alignment correction algorithm which takes into account the rotational variations of skew during the movement of the print media; however, the method involves printing marks on the media and then scanning them with the line sensor on the print carriage to verify if the media has undergone a rotation.

The present invention seeks to provide an automatic pen alignment method which reduces the influence of unstable or transitional conditions of the media advance at the time the alignment is performed, and therefore improves the printing quality.

According to a first aspect, the present invention relates to a method for automatic pen alignment in a printing apparatus, wherein the printing apparatus has a scan direction or x-axis and a media advance direction or y-axis, orthogonal to said scan direction or x-axis, the method comprising the steps of:

- performing a pen alignment process;
- determining an alignment correction algorithm to be applied during subsequent printing, to compensate for the misalignment determined in said pen alignment process;
- measuring an output angle of the media, defined as the angle between the y-axis and the actual direction of advance of the media, with at least one optical sensor arranged stationary on the printing apparatus; and
- employing the measured output angle to modify the alignment correction algorithm to be applied during subsequent printing.

Unlike a line sensor on the carriage, the stationary sensor allows determining the media output angle without being affected by misalignment of the printheads, carriage, etc.; the determined value is employed to reduce the errors that would arise in subsequent printing in the cases in which the media output value changes after the alignment process is performed, such as lack of vertical line straightness and grain.

Further aspects of the invention are as recited in other independent claims.

Particular embodiments of the present invention will be described in the following, only by way of non-limiting example, with reference to the appended drawings, in which.

Figure 1:
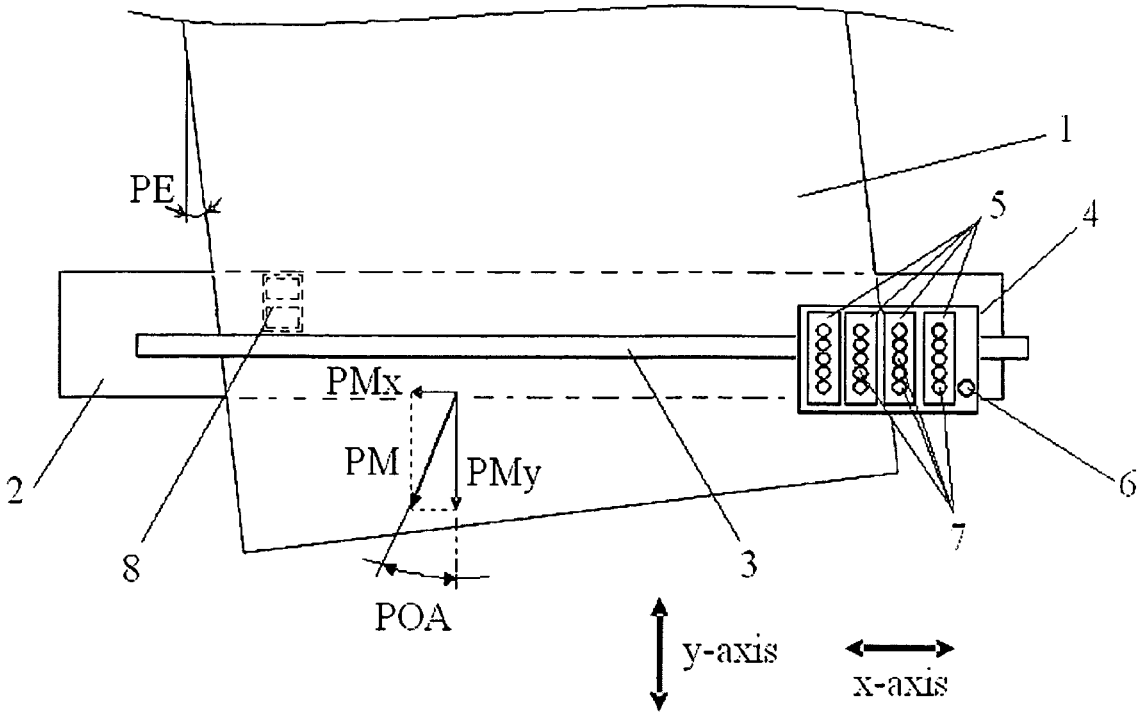
FIG. 1 is a schematic diagram showing the layout of the main parts of a printing apparatus involved in a method according to an embodiment of the present invention, and some parameters relevant to the method.

In the diagram of FIG. 1 a print media 1 is shown on a printing apparatus, in plan view: the apparatus comprises a platen 2 on which the paper or other kind of media 1 is supported and can advance in a media advance direction or y-axis, a scan axis 3 arranged above the platen and extending in a scan direction or x-axis orthogonal to the y-axis, and a carriage 4 which can reciprocate along the scan axis 3 and on which four inkjet printheads 5 are arranged for printing a swath on the media 1 at each travel of the carriage. A line sensor 6 is also mounted on the carriage.

In the drawings the printheads 5 are shown as having five separate groups of nozzles 7, which of course is just a simplification for the sake of clarity.

The paper or media 1 is shown skewed on the print platen 2, i.e. positioned at an angle PE with respect to the advance direction or y-axis.

Apart from this skew, the figure shows a vector PM, with components PMx and PMy in the directions of the x-axis and y-axis, respectively, which indicates the direction in which the paper actually moves on the platen, which in this case is not the media advance direction or y-axis. The angle between the y-axis and this vector PM, i.e. between the theoretical and the actual paper advance direction, is referred to as media output angle or paper output angle, POA.

As can be seen in the figure, the media may be skewed at a certain angle PE on the print platen, and advance with a completely different POA.

The roll of media is loaded in the printer manually by the user, who conveys the media through the paper path until it is presented over the platen, and then aligns the media with respect to a reference line printed on the platen.

However, in this operation the media may be misplaced: as a consequence, when the media is driven forward by a corresponding driving device (not shown) it undergoes a lateral movement, to one side and the other, until it converges to a stable state in which the direction of advance remains constant.

Figure 2:
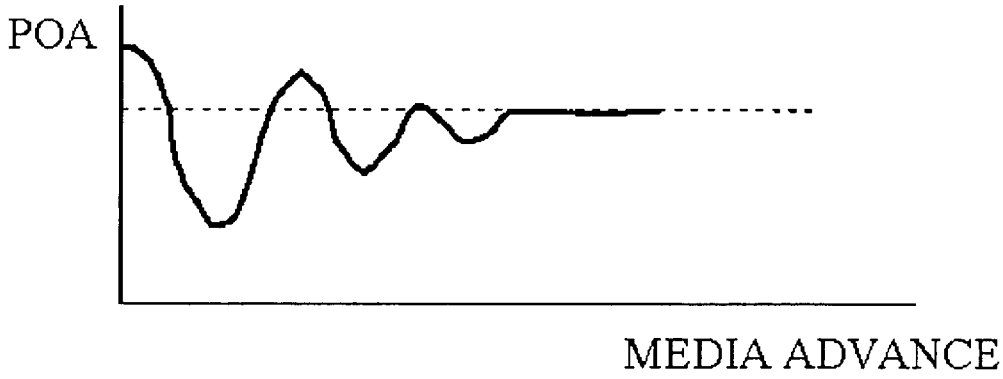
FIG. 2 is a graph showing a typical behaviour of the media output angle of a roll of media when it is first loaded in a printer.

Thus the media movement vector PM and its associated media output angle POA change during the first meters of media advance: generally they oscillate around what later on will be their stable values. This typical oscillation of the POA is shown in the diagram of FIG. 2.

An embodiment of a pen alignment process and its effect on the printing quality will now be described with reference to FIGS. 3 and 4.

Figure 3:
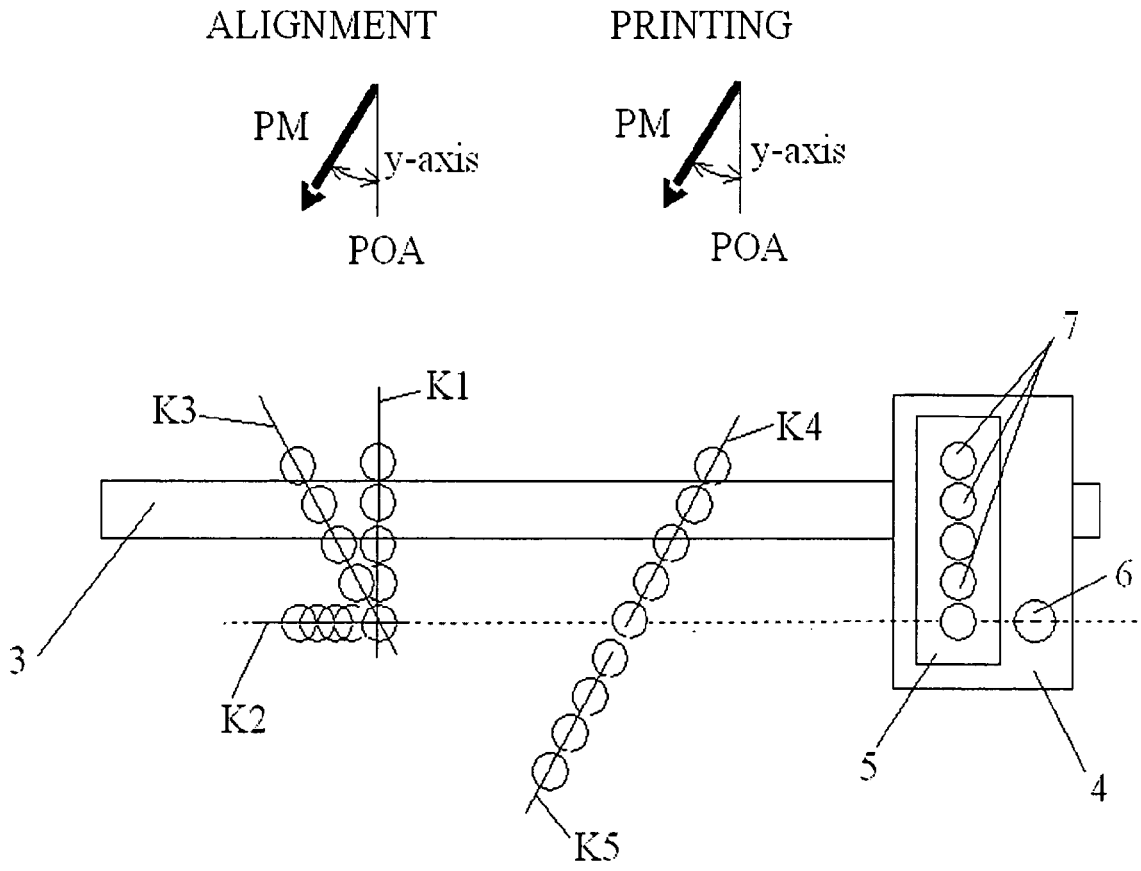
FIGS. 3 and 4 illustrate an automatic pen alignment process and its effect on the printing quality when performed in a stable condition and in an unstable condition, respectively.

In FIG. 3, an automatic pen alignment is performed on a media having a certain POA, as shown on the left hand part of the figure. A vertical line of marks K1 is printed on the media by the groups of nozzles 7 of a printhead 5; then the media is advanced stepwise, in order to let the line sensor 6 successively detect the position of each of the marks along the x-axis. The position of the marks K1 along the x-axis found by the sensor is shown by circles with the reference K2.

Thus, as a result of misalignment of the printhead, of the error in the direction of the advance of the media and other parameters, the line sensor 6 finds that the marks have been printed the media along a line K3 that is not vertical, but tilted an angle with respect to the vertical direction or y-axis.

This information is used to implement an alignment correction algorithm, which is stored and used during subsequent printing to fire the marks in such a way that their position is adequately corrected taking into account the misalignment between the printhead and the media advance direction.

FIG. 3 shows a situation in which the above pen alignment process is performed with the media output angle POA in a stable state: in this case, during subsequent printing the POA will be the same under which the alignment process was run and the correction algorithm was determined: consequently, two consecutive swaths printed by the printhead 5, as shown in the right hand of FIG. 3, will comprise two lines of marks K4 and K5, respectively, which are aligned with each other forming a straight line, parallel to the POA.

Figure 4:
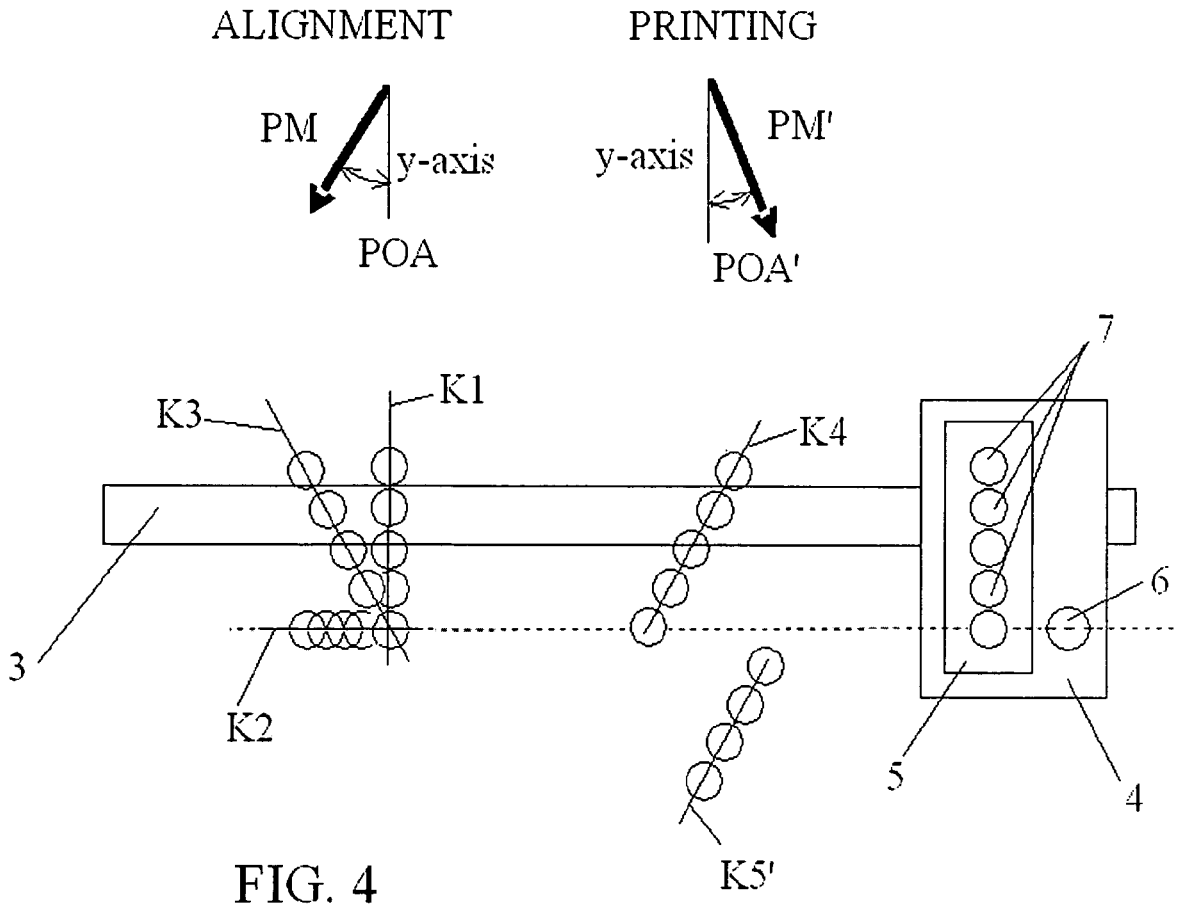

However, if the pen alignment process is run during an unstable condition of the media output angle, the pen alignment disclosed will not provide a satisfactory result in terms of printing quality, as illustrated by FIG. 4. The left hand part of this figure is like that of FIG. 3: media output angle has the same value as in FIG. 3, marks K1 are printed with printhead 5 and scanned with line sensor 6, and the same correction algorithm is triggered for the subsequent printing. However, in this case it is assumed that the alignment process was carried out during an unstable condition of the media output angle, such as when a new media roll is loaded in the printer, so that subsequent printing is performed under a different media output angle POA', as shown in the right hand part of FIG. 4.

In this case, since the correction applied will be the same as before, in a first swath the printhead will print a line of marks K4 much like that of FIG. 3. However, when the media advances before the second swath is printed, it will stop in a different position from that assumed by the correction algorithm, and as a result the line of marks K5' printed in the second swath will not be aligned with the line of the first swath, thus showing a lack of vertical line straightness.

In order to reduce this problem, embodiments of a method for automatic pen alignment of the invention measure the media output angle POA first at the time when the pen alignment process is run (initial media output angle) and later during subsequent printing (further media output angle), for example between each two printed plots or during each plot, and modify the alignment correction algorithm to take into account the effect of the POA.

The initial media output angle may be measured during the pen alignment process itself, more particularly during the advance in which the line sensor 6 detects the position of the marks printed on the media; however, it could also be measured after the pen alignment has been completed and before printing the first plot.

In both cases, several consecutive measures may be carried out, and an average value of the different measures can be stored as the initial media output angle.

In embodiments of the method the alignment correction algorithm is modified before each printed plot, employing the variation between the initial media output angle, measured when the pen alignment process was run, and the further media output angle measured before printing the plot. One such embodiment is illustrated by the flow chart of FIG. 5: in a first step 100, an automatic pen alignment (APA) is run and a correction algorithm is implemented. During the process of the APA, or before printing the first plot, in step 110 an initial media output angle (POAngle_APA) is measured and stored, and then in step 120 a first plot is printed using the correction algorithm as implemented by the APA.

When the next plot has to be printed, according to a decision in step 130, then a further media output angle (POAngle_PRINTING) is measured and stored in step 140; in step 150 the variation between POAngle_APA and POAngle_PRINTING is employed to modify the correction algorithm; and in step 160 the next plot will be printed with a correction algorithm that takes into account that the media output angle is changed with respect to the moment when APA was run.

Figure 5:
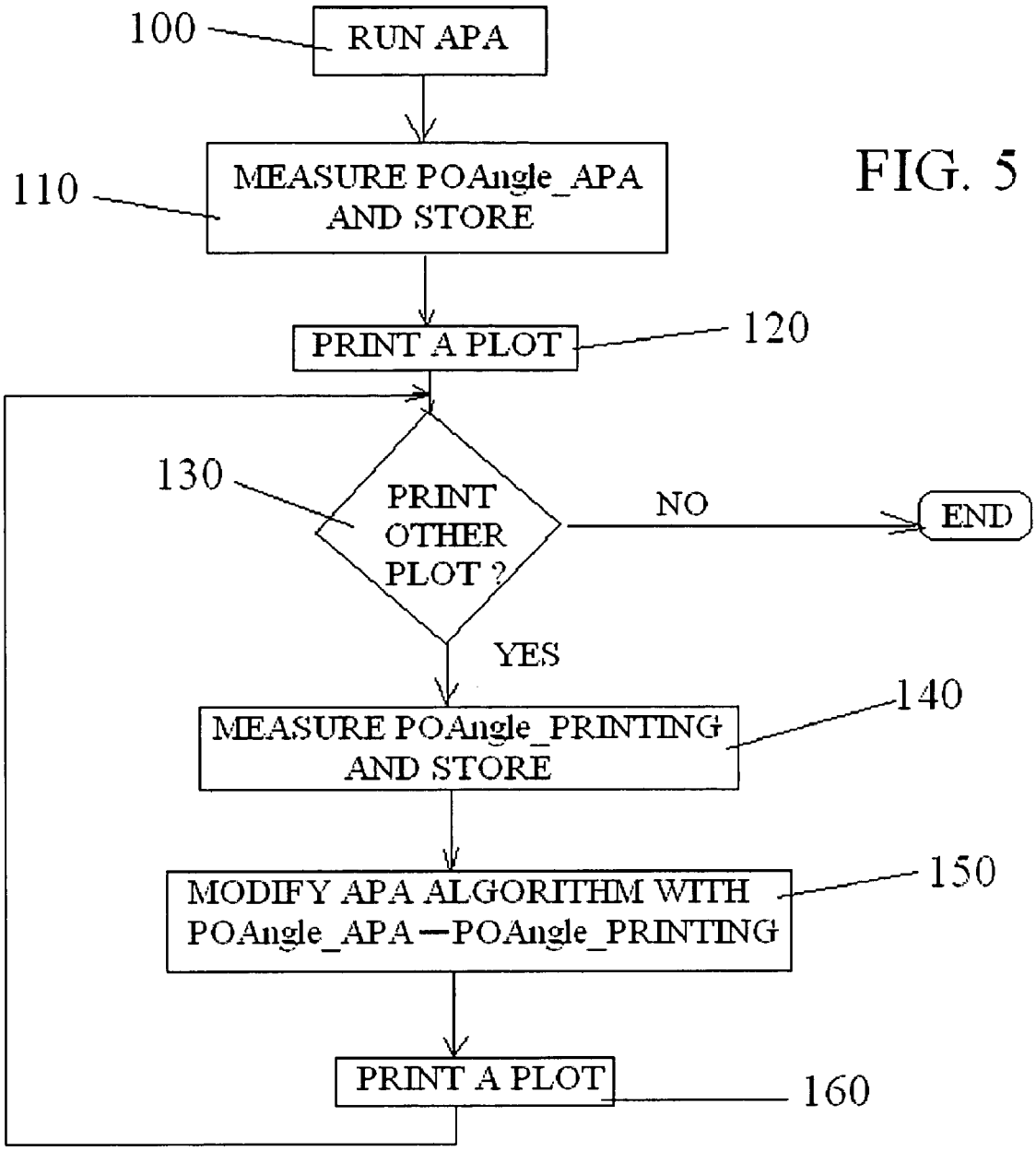
FIG. 5 is a flow chart showing the steps of a method according to an embodiment of the present invention.

The flow chart of FIG. 5 represents only a specific embodiment of a method according to the invention, and several variants of this embodiment are foreseen.

For instance, a new measure of the POAngle could be performed between each two plots as described, or it could be performed only after a number of plots have been printed, or only after a length of media has advanced, etc.

In other embodiments, especially appropriate in the case of non-expansible media, the measure of POAngle_PRINTING may be performed during printing of each plot, instead of being performed between two plots; in this case the measure of the POAngle is taken during the normal advance associated to the printing operation. This allows greater throughput, since the there is no need to provide an additional advance for the measure of POAngle between plots.

When POAngle_PRINTING is measured during printing of a plot it is also possible to repeat the measure and modify the alignment correction several times, for example at regular intervals, such as to modify the algorithm periodically along the plot; this may be useful to obtain a uniform high printing quality, especially in the case of long plots. In some embodiments, when determining the variation between POAngle_APA and POAngle_PRINTING, the median or the mean of the last two or more measures, performed on the last two plots or between the last two plots, can be used for the POAngle_PRINTING. Indeed, any other treatment of the measures may be foreseen in order to increase the improvement of the printing quality afforded by the method.

In general, in embodiments of the method according to the invention, when determining a media output angle it is foreseen to take several measures and treat the measures to obtain a representative value, for example (but not only) by calculating an average of the measured angle, such as to reduce the effect of specific instant conditions.

According to another option, an estimated value for the media output angle once the media is in stable condition (POAngle_STABLE) could be determined at the manufacturing line, and used together with POAngle_APA to modify the alignment correction algorithm after APA is run.

It has been found that media output angle may suffer changes during normal printing, and not only when the roll is loaded; therefore, the method described above may be continued throughout the whole printing process.

For measuring the media output angle an optical sensor 8 is arranged stationary in the printer, facing the underside of the media in the zone of the platen 2, as shown in dotted lines in FIG. 1.

Arranging the sensor on the underside of the media, opposite the printing side, has the advantage that its readings are not affected e.g. by print media thickness.

The measuring operation involves the following process, which is performed at least once:

capturing a first image of the media through the sensor, advancing the media a predetermined distance, capturing a second image of the media through the sensor, and compare the first and second images to determine the output angle of the media.

Depending on when the measurement is performed, the advance may be specifically implemented for the measurement, for example if the measurement is done between two plots. However, the measurement can also be done during an advance already foreseen in the printing operation, as would be the case if the measurement is done while during printing a plot, when the advance of the media between swaths will be employed.

In the case of measuring between plots, the media output angle may be measured during the movement of advance of the media to the cutter line, if the operation of the printer includes cutting the plots.

Optical sensor 8 may be of the type disclosed in U.S. Pat. No. 6,929,342, which is assigned to the assignee of the present invention, for measuring the advance of the media, comprising two individual sensing elements such as charge coupled devices (CCD) arranged at a distance along the y-axis, such that the same area of the media will first pass over one sensing element and then over the other one. In this way, two images of the media can be captured, before and after media advance, and then compared to determine the media output angle by identifying the same element in both images and measuring the vector of displacement of the element between the two images. The sensor 8 is appropriate for capturing images of inherent physical aspects or attributes of the media, such as media fibres.

Figure 6A:
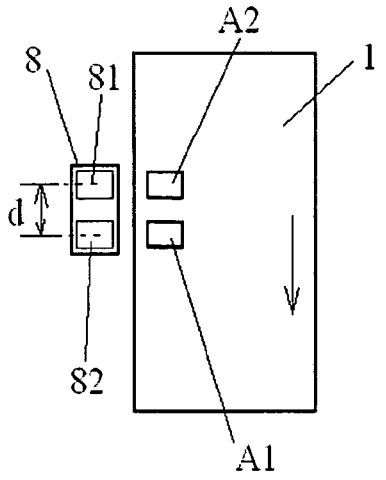
FIGS. 6*a*, 6*b* and 6*c* show the operations of a sensor according to an embodiment of the invention.
Figure 6B:
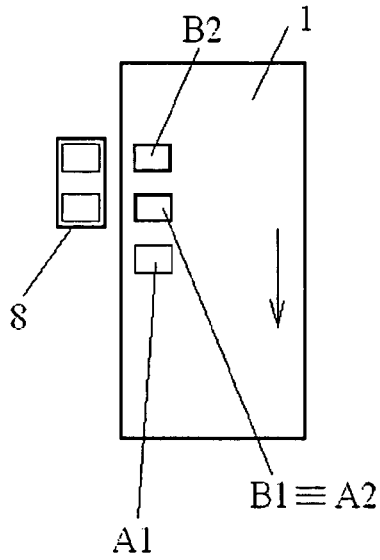
Figure 6C:
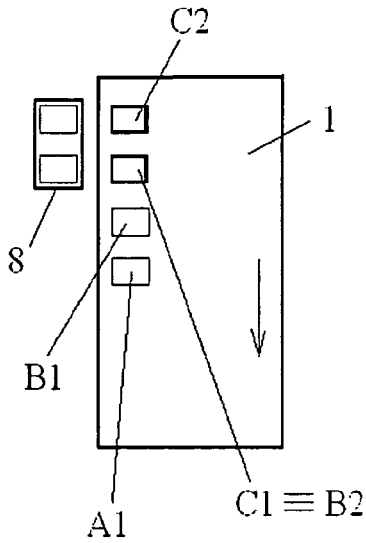

FIGS. 6*a*, 6*b* and 6*c* illustrate very schematically the operation of the sensor 8, showing three successive positions of the media during measurement of the media output angle.

In FIG. 6*a*, A1 and A2 are images of two areas of the media captured by the sensing elements 81 and 82, respectively.

In FIG. 6*b* the media has advanced a distance d, equal to the distance between the centres of the sensing elements 81 and 82, and new images are captured. B1 and B2 are the new images of the media captured by the two sensing elements; however, it will be understood that B1 will be an image of the same area that was captured in image A2 in the previous step if the media advance was accurate and perfectly vertical, or of an area partially overlapping the area captured in A2 if the media advances with a media output angle that is not zero, if there is an error in the advance, etc.

Similarly, in FIG. 6*c* images C1 and C2 are captured by the sensing elements 81 and 82, with C1 being an image of the same area as B2.

By comparing the images A2 and B1, B2 with C1, the vector PM representing the actual media advance direction can be determined at each advance. More particularly, sensor 8 may determine this vector, and therefore the media output angle, by identifying the fibres of the media, and comparing e.g. the position of the same fibre in the two images A2 and B1 for the first step, in the images B2 and C1 for the second step, etc.

In the above figures the sensor 8 is depicted on one side of the media purely for the sake of clarity, and it is understood that it will be generally located either above or below the media.

In embodiments of the invention, the distance d may be about 2 mm.

U.S. Pat. No. 6,929,342, which is incorporated herein by reference, can be referred to for any details regarding the sensor and its operation.

Since the sensor 8 captures images of the media fibres or of similar physical attributes, and does not rely on marks printed by the printheads, its reading is related only to the media movement, and not to a combination of different misalignment factors. This allows employing this information for removing the effect of the unstable media movement from the alignment correction algorithm.

In order to improve the results of the method, it is foreseen to capture between 2 and 40 images, in some embodiments between 20 and 30, at regular intervals of about 2 mm, during a media advance of between 2 and 200 mm, in some embodiments between 4 and 80 mm, over the sensor 8, and take as media output angle POA for modifying the alignment correction algorithm the average of the readings, i.e. the average of the angles measured for each couple of images. In embodiments of the invention the advance could also be smaller than 2 mm.

In embodiments of the invention it is also possible to arrange several optical sensors along the x-axis of the apparatus, thus measuring the media output angle at several locations across the width of the media, and then treating the measures, for example by obtaining an average of the measured media output angles, in order to modify the alignment correction algorithm.

Embodiments of the method have been described in relation to an automatic pen alignment process performed when a new roll of media is loaded in the printer; however, it will be understood that the same method may be applied when automatic pen alignment is run in other circumstances, for example when a printhead is replaced.

Similarly, even if a specific embodiment of a pen alignment process has been described above, embodiments of the invention may be applied to other pen alignment processes, such as pen alignment using interference patterns.

The invention claimed is:

1. A method for automatic pen alignment in a printing apparatus, wherein the printing apparatus has a scan direction or x-axis and a media advance direction or y-axis, orthogonal to said scan direction or x-axis, the method comprising the steps of:

performing a pen alignment process;

determining an alignment correction algorithm to be applied during subsequent printing, to compensate for the misalignment determined in said pen alignment process;

measuring an output angle of the media, defined as the angle between the y-axis and the actual direction of advance of the media, with at least one optical sensor arranged stationary on the printing apparatus; and employing the measured output angle to modify the alignment correction algorithm to be applied during subsequent printing.

2. A method as claimed in claim 1, wherein the step of measuring an output angle of the media is performed during the pen alignment process.

3. A method as claimed in claim 1, wherein said step of measuring an output angle of the media with an optical sensor comprises advancing the media a predetermined distance.

4. A method as claimed in claim 3, wherein during said step of measuring an output angle of the media the optical sensor captures a first image of the media before the media advance and a second image of the media after the media advance, and the first and second images are then compared to determine the output angle of the media.

5. A method as claimed in claim 3, wherein during said step of measuring an output angle of the media the optical sensor captures a plurality of images at regular intervals while the media advances said predetermined distance, and the output angle of the media is determined calculating an average of the output angles obtained comparing each two consecutive captured images.

6. A method as claimed in claim 3, wherein the media is advanced a predetermined distance of less than 200 mm.

7. A method as claimed in claim 1, wherein the optical sensor is appropriate for capturing images of inherent physical aspects or attributes of the media.

8. A method as claimed in claim 1, wherein the optical sensor is arranged facing the surface of the media opposite the printing surface.

9. A method as claimed in claim 1, wherein said step of measuring an output angle of the media is carried out with at least two optical sensors arranged at different positions along the x-axis of the apparatus.

10. A method as claimed in claim 1, wherein the steps of measuring an output angle of the media and employing the measured output angle to modify the alignment correction algorithm are repeated after at least one plot has been printed.

11. A method as claimed in claim 10, wherein said steps are repeated before each new plot is printed.

12. A method as claimed in claim 11, wherein a value of the media output angle is calculated using the media output angles measured in at least two consecutive measuring operations, and this calculated value is employed to modify the alignment correction algorithm.

13. A method as claimed in claim 10, wherein a variation of the media output angle is determined using an initial media output angle measured during the pen alignment process and a further media output angle measured in at least one subsequent measuring operation after the pen alignment process, and this variation is employed to modify the alignment correction algorithm.

14. A method as claimed in claim 1, wherein the steps of measuring an output angle of the media and employing the measured output angle to modify the alignment correction algorithm are repeated during printing of a plot.

15. A method as claimed in claim 14, wherein said steps are performed several times during printing of a plot.

16. A method as claimed in claim 1, wherein the step of performing a pen alignment process comprises printing a vertical line of marks on the media with a printhead mounted on a printhead carriage that can reciprocate along the x-axis, and then detecting the position of each printed mark along the x-axis with a line sensor mounted on the printhead carriage, said detection of the position of the marks being carried out by displacing the media stepwise so as to place each printed mark successively in correspondence with the position of the line sensor.

17. A printing method comprising an automatic pen alignment method as claimed in claim 1.

18. A method for automatic pen alignment in a printing apparatus, wherein the printing apparatus has a scan direction or x-axis and a media advance direction or y-axis, orthogonal to said scan direction or x-axis, said method comprising the steps of:

performing a pen alignment process;

determining an alignment correction algorithm to be applied during subsequent printing, to compensate for the misalignment determined in said pen alignment process;

measuring an output angle of the media, defined as the angle between the y-axis and the actual direction of advance of the media with at least one stationary optical sensor capable of recognizing media fibres, said sensor performing the following substeps: (a) capturing a first image of the media with the optical sensor; (b) advancing the media a predetermined distance; (c) capturing a second image of the media with the optical sensor; and (d) comparing the first and second images to determine the output angle of the media; and employing the measured output angle to modify the alignment correction algorithm to be applied during subsequent printing.

19. A method for automatic pen alignment in a printing apparatus, wherein the printing apparatus has a scan direction or x-axis and a media advance direction or y-axis, orthogonal to said scan direction or x-axis, the method comprising the steps of:

performing a pen alignment process;

determining an alignment correction algorithm to be applied during printing, to compensate for the misalignment determined in said pen alignment process;

determining during said pen alignment process an initial output angle of the media, defined as the angle between the y-axis and the actual direction of advance of the media, with at least one optical sensor arranged stationary on the printing apparatus;

determining a further output angle of the media after printing has started on said roll of print media, and employing a variation between the initial output angle and the further output angle to modify the alignment correction algorithm to be applied during subsequent printing.

20. A method as claimed in claim 19, wherein at least one of the steps of determining an initial media output angle and determining said further media output angle are carried out taking several measures of the media output angle and treating the measures to obtain a representative value.

* * * * *